US005318020A

United States Patent [19]

Schegerin

[11] Patent Number: 5,318,020

[45] Date of Patent: Jun. 7, 1994

[54] EQUIPMENT FOR RESPIRATORY PROTECTION AGAINST POLLUTANTS

[75] Inventor: Robert Schegerin, Jouy en Josas, France

[73] Assignee: Intertechnique, France

[21] Appl. No.: 928,339

[22] Filed: Aug. 12, 1992

[30] Foreign Application Priority Data

Aug. 21, 1991 [FR] France ..... 91 10495

[51] Int. Cl.[5] ..... A62B 18/08; F04B 49/06

[52] U.S. Cl. ..... 128/205.12; 128/204.21; 128/205.29; 417/45

[58] Field of Search ..... 128/204.21, 294.28, 128/205.12, 205.13, 205.16, 205.18, 205.29, 204.18, 205.25; 417/45; 318/139, 442, 558

[56] References Cited

U.S. PATENT DOCUMENTS

| | | | |
|---|---|---|---|
| 3,822,698 | 7/1974 | Guy | 128/201.25 |
| 4,430,995 | 2/1984 | Hilton | 128/204.21 |
| 4,886,056 | 12/1989 | Simpson | 128/201.25 |
| 4,899,740 | 2/1990 | Napolitano | 128/202.22 |
| 5,009,225 | 4/1991 | Vrabel | 128/201.24 |
| 5,044,362 | 9/1991 | Younes | 128/204.21 |
| 5,134,995 | 8/1992 | Gruenke | 128/204.23 |
| 5,199,424 | 4/1993 | Sullivan et al. | 128/204.18 |

FOREIGN PATENT DOCUMENTS

| | | |
|---|---|---|
| 0334555 | 9/1989 | European Pat. Off. . |
| 0352938 | 1/1990 | European Pat. Off. . |
| 0413555 | 2/1991 | European Pat. Off. . |
| 2103095 | 2/1983 | United Kingdom . |

*Primary Examiner*—Edgar S. Burr
*Assistant Examiner*—Eric P. Raciti
*Attorney, Agent, or Firm*—Larson & Taylor

[57] ABSTRACT

An Equipment for respiratory protection against pollutants, for use at low altitude comprises a face cover fitted with an atmospheric air supply comprising a filter, a rotary fan to compensate for the head loss due to the filter, and a flexible hose, as well as a self-contained electric power source for energizing the rotary fan, supplying a rated voltage $V_0$. The fan supplies, under its rated voltage $V_0$, an air flow rate higher than that necessary for the wearer when the latter is in rest condition, but far lower than the air flow rate required in case of abnormal activity. A pressure sensor causes a temporary increase in the voltage applied to the fan when the overpressure prevailing in the face cover with respect to the surrounding is lower than a predetermined value.

6 Claims, 1 Drawing Sheet

EQUIPMENT FOR RESPIRATORY PROTECTION AGAINST POLLUTANTS

BACKGROUND OF THE INVENTION

The present invention concerns an equipment for respiratory protection against pollutants and noxious products, for use at low altitude (typically up to 12,500 ft) that is to say, in an atmosphere whose pressure is sufficiently high for rendering unnecessary to supply oxygen-enriched air to the lungs. It finds a particularly important application in so-called NBC protective equipment, designed to protect at least the respiratory tract (and often the entire skin surface) of a wearer against pollutants dispersed in the atmosphere.

Equipment of this type is already known, comprising a face cover (hood or full mask if the entire head must be protected, mask covering the breathing orifices if skin protection is unnecessary or is achieved by other means) fitted with an atmospheric air supply comprising a filter, a rotary fan or blower to compensate for the head loss due to the filter, and a flexible hose, as well as a self-contained electric power source for the rotary fan, supplying a rated voltage $V_0$ to the motor of the fan.

The air flow to be supplied to the wearer of the equipment changes enormously depending on the degree of activity of the wearer. It is generally in conditions in which protection is indispensable that the wearer requires a maximum flow rate, either during a single unhale period, or during a significant time interval. In fact, an air draw by inspiration which is not immediately offset by an available delivery air flow rate causes the face mask to be under negative pressure and a risk of ingress of polluted air.

The problem can be alleviated by connecting a flexible economizer bag to the face cover. While this solution helps to absorb short inspiratory peaks, it does not make it possible to offset increases in the average flow rate. Moreover, economizer bags are bulky and prone to wear and tear.

In consequence, the solution generally adopted so far has been to dimension the fan so that it continuously supplies a flow rate at least equal to the needs in the most critical conditions. However, this increases electric power consumption and hence necessitates an increase in weight of the batteries for a given operational life. The large air flow rate which permanently passes through the filter reduces its service life unnecessarily due to faster clogging.

A breathing apparatus is also known (EP-A-0334555) having an outer full face mask and an inner oro-nasal mask. Means responsive to the pressure difference across the oro-nasal mask disable the fan at the commencement of each inhale period and energize the fan at the commencement of each unhale period. Such an apparatus is complex; the fan operates under conditions which may detrimentally affect its life. The buffer space between the masks increases the head loss.

SUMMARY OF THE INVENTION

It is an object of the invention to provide breathing equipment which makes it possible to significantly reduce the size and weight of the unit consisting of the fan and the power source, and to lengthen the service life of the filter as compared with an apparatus continuously delivering the maximum flow, without any sacrifice in protection.

It is another object to achieve that result with equipment which is simple in design and rugged in operation.

For that purpose, the invention proposes equipment wherein the fan is selected to supply, under a rated voltage $V_0$, an air flow rate higher than that necessary for the wearer at rest, and far lower than the flow rate required in case of abnormal activity, and wherein the equipment comprises a pressure sensor causing a temporary increase in the voltage applied to the fan from $V_0$ to a higher value, sufficient for an increase of the flow rate to a value at least equal to the maximum average flow rate required by the wearer when the overpressure prevailing in the face cover with respect to the ambient atmosphere becomes lower than a predetermined value.

In practice, the fan can be designed to supply a flow rate of about 70 liters per minute NTPD under its normal service voltage (such value being higher than the 20–40 l/mm required for breathing during the inhale period), while maintaining an overpressure of a few millibars in the face cover, and to supply at least twice this flow rate when placed under overvoltage.

The invention could only be achieved thanks to the finding of two facts. The first is that the small fans which suffice to supply the required peak flow rate have a sufficiently low inertia for acceleration from the steady flow rate under voltage $V_0$ to the flow rate required to satisfy the metabolism in case of emergency to take place in less than ½ second. The second fact is that a conventional rotary fan is capable of operating, at the cost of a simple progressive temperature rise, during a period substantially longer than one minute. This period is sufficient in most cases, as in the case of a helicopter pilot faced with a critical situation suddenly, but during a short time interval, or of a fireman who has to make short intense muscular effort.

The temporary voltage increase in response to a signal generated by the sensor is generally controlled by an electronic circuit. This circuit can, for example, be designed, if the overpressure decreases below a first threshold, to increase the voltage applied up to a higher value $V_1$ (so as to cause a rapid acceleration of the fan) for a short time and then to maintain an intermediate voltage $V_2$ for a preset time interval, for example 2 seconds, this interval may be repeated or extended as long as the overpressure does not remain higher than another threshold value, higher than the first threshold for a preset time interval.

The invention will be better understood from the following description of particular embodiments of the invention, given as examples. The description refers to the accompanying drawings.

DESCRIPTION OF EMBODIMENTS

Figure 1:
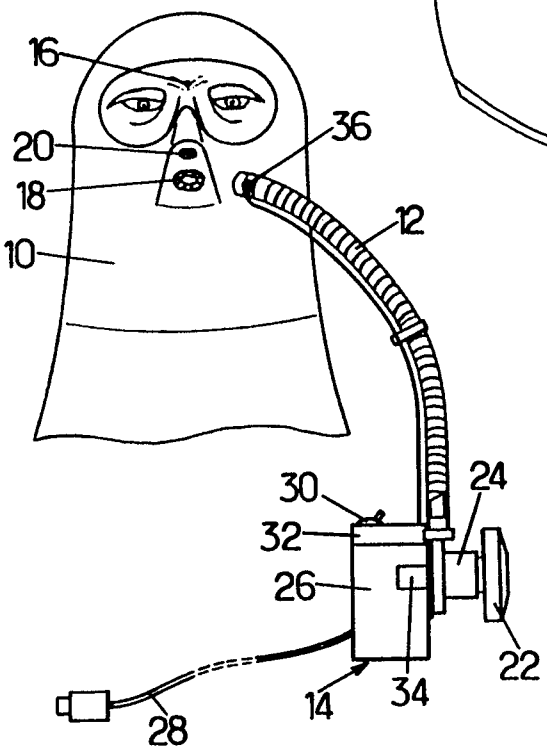

The equipment shown systematically in FIG. 1 comprises a face cover consisting of a hood 10 connected by a flexible hose 12 to a unit 14 for supplying the hood with atmospheric air. As shown, the hood 10 has a transparent visor 16 and an exhale check valve 18. It may also comprise an anti-suffocation spring-loaded check valve 20 which opens in case of failure of the air supply unit 14. The air is generally admitted into the hood, at least partly, through a diffuser for demisting the visor.

The air supply unit can be regarded as comprising a filter 22 of a suitable type for the desired protection, which may comprise several cascaded filter elements in a same canister, and a rotary fan 24 energized by an electric motor. In the embodiment illustrated, the fan is carried directly by a casing 26 which also contains a storage battery making the equipment self-contained. In the case of equipment designed for use on an aircraft, the casing 26 may also be provided with a cord 28 for electric power supply from the on-board DC network, generally at a voltage of 28 volts. Then a voltage reducing circuit (not shown) may be provided in the casing 26 and may maintain the battery, which then operates as a buffer, fully loaded.

The casing also carries usual control and/or test components, such as an on-off manual switch 30.

The equipment according to the invention contains, generally in casing 26, a circuit 32 for applying to the electric motor 34 of the fan 24 a voltage which depends on the breathing requirements of the wearer of the hood 10. Since it is always easier to reduce the voltage supplied by a power source that to increase it, a motor 34 is generally used designed to operate in continuous duty under a voltage $V_0$ which is much lower than the maximum voltage that can be supplied by the battery contained in the casing 26 and/or the voltage of the on-board network.

As an example, a micro-fan can be used, capable of supplying a flow rate of about 50 liters per minute when a D.C. voltage $V_0=8$ volts is applied to its motor. This voltage $V_0$ is generated, from the voltage of the power supply network (when cable 28 is connected) or from the voltage of the storage battery, by circuit 32.

An equipment according to the invention also comprises a sensor responsive to the pressure differential between the breathing circuit and the surrounding atmosphere. As shown in FIG. 1, the sensor 36 is placed on the hose 12, immediately upstream from the inlet to the hood 10. The sensor, or the circuit 32 to which it is connected, is designed to generate a control signal when the overpressure $\Delta p$ drops below a predetermined value, which generally ranges between 0 and +2 millibar but in certain cases may be slightly negative, up to −1 mbar.

The electronic circuit 32 is designed to apply temporarily, to the motor 34, a higher voltage when the overpressure $\Delta p$ drops below the predetermined value.

Figure 3:
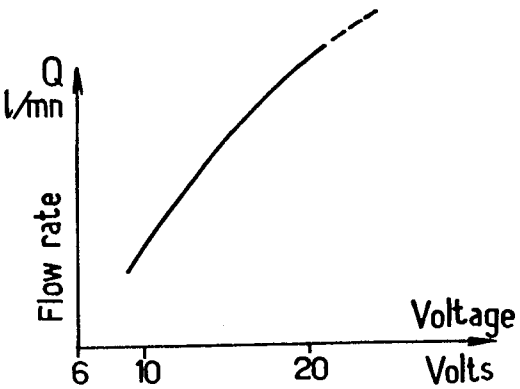
FIG. 3 shows an example of a curve representating the variation in flow rate as a function of the applied voltage, for a constant pressure differential.

As shown in FIG. 3, the increase in the voltage applied to the motor of a fan, for a given head loss, results in an increase in the delivered flow rate.

Since the head loss increases, especially across the filter, responsive to an increase in the flow rate, the increase in the flow rate, plotted against the voltage, is slightly slower than shown in FIG. 3. However, it appears that doubling of the applied voltage, (an increase which most existing fans can tolerate, during an interval significantly longer than one minute, without any drawback other than a progressive temperature rise) results in a considerable increase in the flow rate. In practice, a threefold increase of the applied voltage is perfectly acceptable if during a short time interval.

Depending on the intended application, various operating sequences can be selected in response to a drop of the overpressure below the threshold. The sequence or sequences can be programmed in circuit 32. A law of variation of the type shown in FIG. 4 may for example be selected. At time $t_0$, when the overpressure $\Delta p$ drops below the threshold, the power supply voltage is raised from $V_0$ to $V_1$, which is the maximum value that can be supplied by the electric power supply and/or the storage battery (for example, 28 volts instead of 8 volts . Under this higher voltage, a current micro-fan can reach a new steady air flow rate, twice or three times the original flow rate, in a time interval $\delta t$ of about 0.2 second. The new voltage $V_1$ can be maintained for a preset time interval, for example one second, and then the voltage may be reduced to an intermediate value $V_2$, for which the flow rate is about twice the flow rate under voltage $V_0$. The voltage is finally brought back to $V_0$ after a preset time (for example 2 seconds) and/or as soon as the overpressure $\Delta p$ has remained higher than another threshold which is higher than the original threshold, for longer than a preset time interval, for example 1 second.

Figure 4:
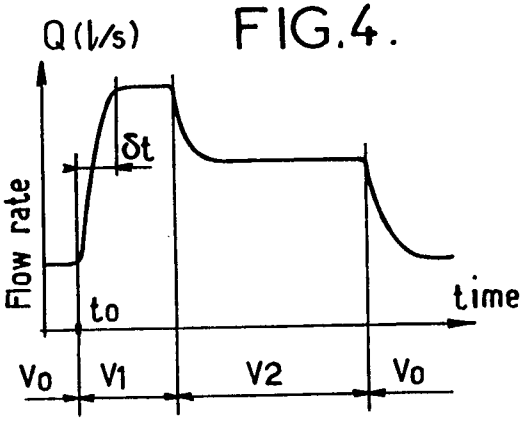
FIG. 4 is a diagram showing a possible control law for the fan.

The cycle shown in FIG. 4 can be repeated at each inspiration as long as it results in a deep air draw due to abnormal conditions. The circuit 32 can even be programmed to repeat the cycle in FIG. 4 upon each inspiration a predetermined number of times after the last occurrence of initiation of the cycle by a decrease in the overpressure $\Delta p$ below the first threshold.

The cycle shown in FIG. 4 is not the only one possible. A more simple solution is to increase the applied voltage from value $V_0$ to value $V_2$ and to keep it applied as long as the overpressure has not continuously remained higher than another preset threshold during a stored time interval, generally a few seconds.

The casing 26 may advantageously carry an additional switch (not shown) enabling the wearer to place the fan motor temporarily under continuous overvoltage when he deems it necessary, for instance just before he has to exert efforts.

Figure 2:
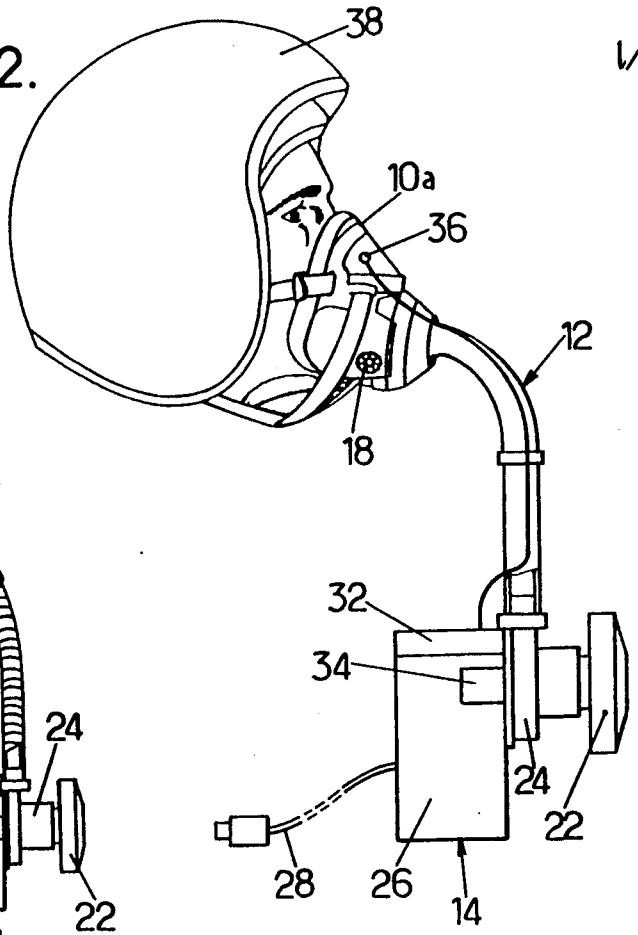
FIGS. 1 and 2 are schematic drawings showing two equipments according to the invention, one comprising a hood, and the second a breathing mask.

In the modified embodiment shown in FIG. 2 (where the components corresponding to those of FIG. 1 are designated by the same reference number) the face cover consists of a mask 10*a* fixed to a helmet 36. The protection can be complemented with goggles or the mask can cover the entire face.

Many other embodiments of the invention are possible. For example, the pressure differential can be measured directly at the fan outlet. Some components can be duplicated for safety. The fan can also feed a demisting diffuser if a hood is used.

It is useless to describe here the control circuit 32: many circuits of this type are available on the market, designed to supply, from a voltage equal to or higher than $V_2$, one or more lower voltages. If the power is supplied by a storage battery, such a circuit can operate simply by switching for achieving several different combinations of battery elements. In case of an electric power supply having a fixed voltage, for example $V_2=28$ volts, the system may be a circuit using cut-off transistors, a control network delivering pulses of current with a variable duty ratio and an electric smoothing filter. The unit 14 can further comprise charge components or rectifiers which serve to keep the battery at its maximum voltage as long as the equipment is connected to an onboard network.

I claim:

1. Equipment for respiratory protection against pollutants, for use at low altitude, comprising:

a face cover;

air supply means for drawing air from atmosphere and delivering it to the interior of the face cover, having, in series relation, air filter means, a rotary fan drivably connected to an electric motor rated for continuous operation under a predetermined rated voltage, and a flexible hose connected to said face over, said fan delivering a first air flow rate in excess of an average flow rate of 40 l/mm when said rated voltage is applied to said motor;

an autonomous electric power source;

a pressure sensor for delivering a signal responsive to an amount of overpressure downstream of said rotary fan as compared with ambient pressure; and control circuit means connected to receive said signal and connected to said source, for causing said source to apply said rated voltage to said motor as long as said amount of overpressure exceeds a predetermined threshold comprised between −1 and +2 millibar and, responsive to said pressure differential becoming lower than said predetermined threshold, for causing said source to firstly increase said supply voltage up to an increased voltage during a predetermined time duration, to later maintain an intermediary voltage, comprised between said rated voltage and said increased voltage, during another predetermined period and then to apply said rated voltage again to said motor.

2. Equipment according to claim 1, wherein said control means comprises means for further extending said other predetermined period as long as said amount of pressure differential does not remain higher than another threshold, higher than the first-named threshold, for a predetermined time period.

3. Equipment for respiratory protection against pollutants, for use at low altitude, comprising:

a face cover;

air supply means for drawing air from atmosphere and delivering it to the interior of the face cover, having in series relation, air filter means, a rotary fan drivably connected to an electric motor dimensioned for continuous operation under a predetermined rated voltage, and a flexible hose connected to said face cover, said fan delivering a first air flow rate in excess of an average flow rate of 40 l/mm when said rated voltage is applied to said motor;

an autonomous electric power source able to deliver either a rated voltage or a predetermined increased voltage;

a pressure sensor for delivering a signal responsive to an amount of overpressure downstream of said rotary fan as compared with ambient pressure; and control circuit means connected to receive said signal and connected to said source, for automatically controlling said source responsive to said signal and for causing said source to deliver said rated voltage to said motor as long as said amount of overpressure exceeds a predetermined threshold comprised between −1 and +2 millibar and to cause said source to temporarily apply said increased voltage to said motor at least as long as said amount of overpressure becomes lower than the predetermined threshold.

4. Equipment according to claim 3, wherein said filter, fan and motor constitute an integrated unit with an electrical battery capable to deliver said increased voltage directly.

5. Equipment according to claim 4, wherein said integrated unit is further provided with a cord for electrical connection to an on-board electrical network and includes a voltage reducing circuit for loading said battery from the network.

6. Equipment for respiratory protection against pollutants, for use at low altitude, comprising:

a face cover;

air supply means for drawing air from atmosphere and delivering it to the interior of the face cover, having filter means, a rotary fan drivably connected to an electric motor designed for operation under a predetermined rated voltage and a flexible hose connected to said face cover, said fan delivering a first air flow rate in excess of a predetermined average flow rate at least equal to 40 l/mm when predetermined rated voltage is applied to said motor;

an autonomous electric power source constructed to optionally deliver either said predetermined rated voltage or a second predetermined voltage approximately twice said predetermined rated voltage;

a pressure sensor for delivering a signal responsive to an amount of overpressure downstream of said rotary fan as compared with ambient pressure; and electronic control means connected to receive said signal and connected to said source for automatically controlling said source responsive to said signal and for causing said source to apply said predetermined rated voltage to said motor as long as said amount of overpressure exceeds a predetermined threshold comprised between −1 and +2 millibar and to temporarily apply said second predetermined voltage to said motor when said amount of overpressure becomes lower than the predetermined threshold.

* * * * *